US009367074B2

(12) United States Patent
Tomioka et al.

(10) Patent No.: US 9,367,074 B2
(45) Date of Patent: Jun. 14, 2016

(54) VOLTAGE REGULATOR CAPABLE OF STABILIZING AN OUTPUT VOLTAGE EVEN WHEN A POWER SUPPLY FLUCTUATES

(71) Applicant: Seiko Instruments Inc., Chiba-shi, Chiba (JP)

(72) Inventors: Tsutomu Tomioka, Chiba (JP); Masakazu Sugiura, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 66 days.

(21) Appl. No.: 14/551,813

(22) Filed: Nov. 24, 2014

(65) Prior Publication Data

US 2015/0168971 A1 Jun. 18, 2015

(30) Foreign Application Priority Data

Dec. 13, 2013 (JP) ..... 2013-258394

(51) Int. Cl.

| | |
|---|---|
| ***G05F 1/00*** | (2006.01) |
| ***H02H 7/00*** | (2006.01) |
| ***H02H 9/00*** | (2006.01) |
| ***G05F 1/565*** | (2006.01) |
| ***G05F 1/56*** | (2006.01) |

(52) U.S. Cl.
CPC ..... *G05F 1/565* (2013.01); *G05F 1/562* (2013.01)

(58) Field of Classification Search
CPC ..... G05F 1/461; G05F 1/462; G05F 1/56; G05F 1/562; G05F 1/563; G05F 1/565; G05F 1/569; G05F 1/571; G05F 1/575; H02M 2001/0045; H02M 3/156; H03K 17/04126; H03K 17/04166; H03K 17/04213; H03K 17/0826; H02H 3/20; H02H 3/207
USPC ..... 323/246, 274, 275, 284–286, 289; 361/18
See application file for complete search history.

(56) References Cited

U.S. PATENT DOCUMENTS

| | | | | |
|---|---|---|---|---|
| 7,863,881 | B2 | 1/2011 | Inoue | |
| 2009/0085534 | A1* | 4/2009 | Ko | G05F 1/575 323/270 |
| 2010/0213913 | A1* | 8/2010 | Shito | G05F 1/575 323/284 |
| 2012/0013317 | A1* | 1/2012 | Morino | G05F 1/565 323/280 |

FOREIGN PATENT DOCUMENTS

JP 2007-157071 A 6/2007

* cited by examiner

*Primary Examiner* — Adolf Berhane
*Assistant Examiner* — Gary Nash
(74) *Attorney, Agent, or Firm* — Brinks Gilson & Lione

(57) ABSTRACT

Provided is a voltage regulator configured to suppress overshoot and undershoot so as to output a stabilized voltage. The voltage regulator includes: a high pass filter configured to detect a fluctuation in power supply voltage; a high pass filter configured to detect a fluctuation in output voltage; transistors connected in series, which are each configured to cause a current to flow in accordance with an output of corresponding one of the high pass filters; and a clamp circuit configured to clamp a drain voltage of one of the transistors connected in series. The voltage regulator controls a gate voltage of an output transistor based on a drain voltage of a transistor that includes a gate controlled by the drain voltage of the one of the transistors connected in series.

7 Claims, 7 Drawing Sheets

VOLTAGE REGULATOR CAPABLE OF STABILIZING AN OUTPUT VOLTAGE EVEN WHEN A POWER SUPPLY FLUCTUATES

RELATED APPLICATIONS

This application claims priority under 35 U.S.C. §119 to Japanese Patent Application No. 2013-258394 filed on Dec. 13, 2013, the entire content of which is hereby incorporated by reference.

BACKGROUND OF THE INVENTION

1. Field of the Invention

The present invention relates to a voltage regulator capable of stabilizing an output voltage even when a power supply fluctuates.

2. Description of the Related Art

A related-art voltage regulator is now described. FIG. 9 is a circuit diagram illustrating the related-art voltage regulator.

The related-art voltage regulator includes an error amplifier circuit 103, a reference voltage circuit 102, PMOS transistors 901 and 902, an output transistor 105, resistors 106, 107, and 903, a fluctuation detection capacitor 904, a clamp circuit 905, a ground terminal 100, an output terminal 104, and a power supply terminal 101.

The resistors 106 and 107 are connected in series between the output terminal 104 and the ground terminal 100, and divide an output voltage Vout generated at the output terminal 104. A voltage generated at a connection point of the resistors 106 and 107 is represented by Vfb. The error amplifier circuit 103 controls a gate voltage of the output transistor 105 so that the voltage Vfb may approach a voltage Vref of the reference voltage circuit 102, to thereby control the output transistor 105 to output an output voltage Vout from the output terminal 104. When a power supply voltage VDD of the power supply terminal 101 increases, a current Ix1 is allowed to flow from the power supply terminal 101 to the fluctuation detection capacitor 904. The current Ix1 is amplified by a current feedback circuit including the PMOS transistors 901 and 902 and the resistor 903, to thereby generate a current Ix2. The current Ix2 is supplied to a gate of the output transistor 105 to charge a gate capacitance of the output transistor 105. In this manner, a gate-source voltage VGS of the output transistor 105 is adjusted to an appropriate value even when the power supply voltage VDD corresponding to a source voltage of the output transistor 105 fluctuates, and hence overshoot is suppressed to stabilize the output voltage Vout (see, for example, Japanese Patent Application Laid-open No. 2007-157071).

However, the related-art voltage regulator has a problem in that, when the power supply voltage continues to fluctuate even after the fluctuation in power supply voltage is detected to suppresses the overshoot of the output voltage, the voltage regulator continues to control the output transistor excessively to generate undershoot or another overshoot. Further, the related-art voltage regulator has another problem in that, when the power supply voltage fluctuates quickly under a heavy load and undershoot is generated after the overshoot of the output voltage is suppressed, the voltage regulator erroneously detects an operation of subsequently increasing the output voltage to control the output transistor, resulting in oscillation.

SUMMARY OF THE INVENTION

The present invention has been made in view of the above-mentioned problems, and provides a voltage regulator capable of stabilizing an output voltage even when a power supply voltage continues to fluctuate even after overshoot of the output voltage is suppressed or when overshoot or undershoot is generated due to a power supply fluctuation under a heavy load.

In order to solve the related-art problem, a voltage regulator according to one embodiment of the present invention has the following configuration.

The voltage regulator includes: a high pass filter configured to detect a fluctuation in power supply voltage; a high pass filter configured to detect a fluctuation in output voltage; transistors connected in series, which are each configured to cause a current to flow in accordance with an output of corresponding one of the high pass filters; and a clamp circuit configured to clamp a drain voltage of one of the transistors connected in series. The voltage regulator controls a gate voltage of an output transistor based on a drain voltage of a transistor that includes a gate controlled by the drain voltage of the one of the transistors connected in series.

According to the voltage regulator of one embodiment of the present invention, the overshoot of the output voltage can be suppressed and undershoot that is generated thereafter can be prevented, thereby being capable of stabilizing the output voltage quickly.

DETAILED DESCRIPTION OF THE PREFERRED EMBODIMENTS

In the following, embodiments of the present invention are described with reference to the drawings.

First Embodiment

Figure 1:
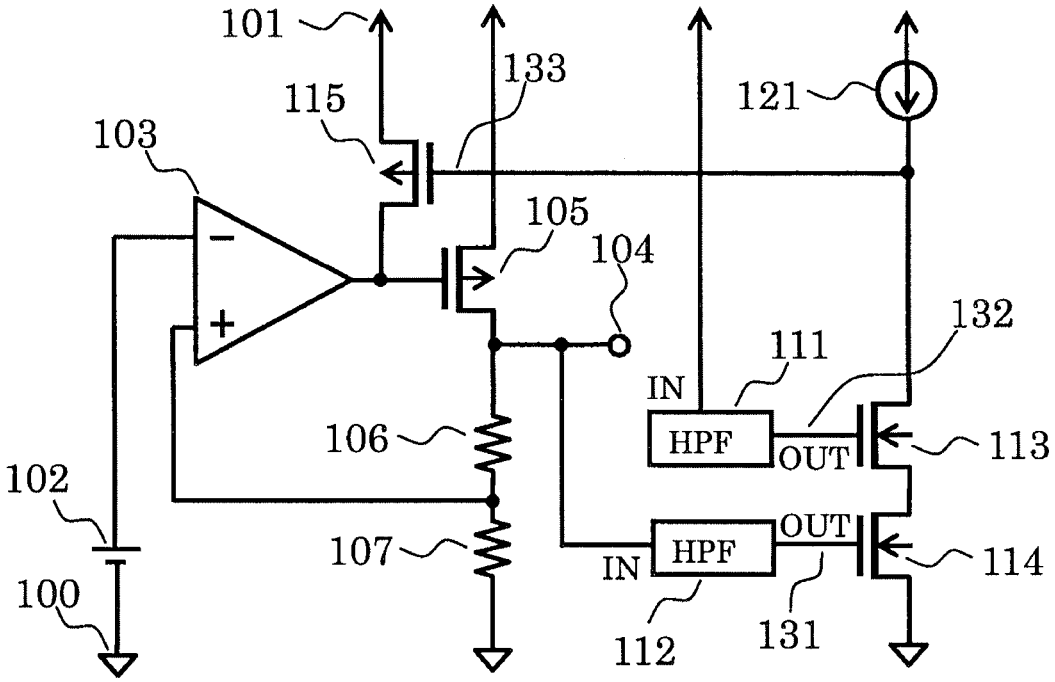
FIG. 1 is a circuit diagram illustrating a voltage regulator according to a first embodiment of the present invention.

FIG. 1 is a circuit diagram of a voltage regulator according to a first embodiment of the present invention.

The voltage regulator according to the first embodiment includes an error amplifier circuit 103, a reference voltage circuit 102, an output transistor 105, resistors 106 and 107, high pass filters 111 and 112, NMOS transistors 113 and 114, a PMOS transistor 115, a bias circuit 121, a ground terminal 100, an output terminal 104, and a power supply terminal 101.

Figure 2:
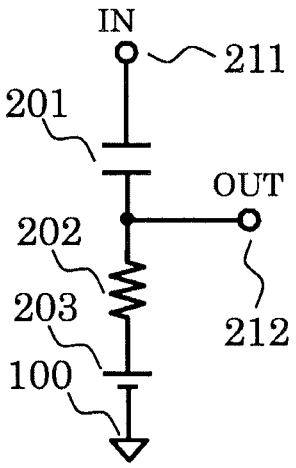
FIG. 2 is a circuit diagram illustrating an exemplary high pass filter.

FIG. 2 is a circuit diagram of the high pass filters 111 and 112. The high pass filters 111 and 112 each include a capacitor 201, a resistor 202, a constant voltage circuit 203, an input terminal 211, and an output terminal 212.

Next, connections in the voltage regulator according to the first embodiment are described.

The error amplifier circuit 103 has an inverting input terminal connected to a positive electrode of the reference voltage circuit 102 and a non-inverting input terminal connected to a connection point of one terminal of the resistor 106 and one terminal of the resistor 107. The reference voltage circuit 102 has a negative electrode connected to the ground terminal 100. The other terminal of the resistor 107 is connected to the ground terminal 100, and the other terminal of the resistor 106 is connected to the output terminal 104. The output transistor 105 has a gate connected to an output terminal of the error amplifier circuit 103, a source connected to the power supply terminal 101, and a drain connected to the output terminal 104. The PMOS transistor 115 has a drain connected to the output terminal of the error amplifier circuit 103, a source connected to the power supply terminal 101, and a gate connected to a drain of the NMOS transistor 113 via a node 133. The bias circuit 121 has one terminal connected to the drain of the NMOS transistor 113 and the other terminal connected to the power supply terminal 101. The NMOS transistor 113 has a source connected to a drain of the NMOS transistor 114 and a gate connected to the output terminal 212 of the high pass filter 111 via the node 132. The NMOS transistor 114 has a source connected to the ground terminal 100 and a gate connected to the output terminal 212 of the high pass filter 112 via a node 131. The input terminal 211 of the high pass filter 111 is connected to the power supply terminal 101, and the input terminal 211 of the high pass filter 112 is connected to the output terminal 104. The capacitor 201 has one terminal connected to the input terminal 211 and the other terminal connected to the output terminal 212. The resistor 202 has one terminal connected to the output terminal 212 and the other terminal connected to a positive electrode of the constant voltage circuit 203. The constant voltage circuit 203 has a negative electrode connected to the ground terminal 100.

Next, an operation of the voltage regulator according to the first embodiment is described.

When a power supply voltage VDD is input to the power supply terminal 101, the voltage regulator outputs an output voltage Vout from the output terminal 104. The resistors 106 and 107 divide the output voltage Vout and output a divided voltage Vfb. The error amplifier circuit 103 compares a reference voltage Vref of the reference voltage circuit 102 and the divided voltage Vfb, and controls a gate voltage of the output transistor 105 so that the output voltage Vout is constant. The bias circuit 121 operates as a clamp circuit, and clamps the gate voltage of the PMOS transistor 115 at the power supply voltage VDD to turn off the PMOS transistor 115.

When the output voltage Vout is higher than a predetermined voltage, the divided voltage Vfb is higher than the reference voltage Vref. Hence, an output signal of the error amplifier circuit 103 (the gate voltage of the output transistor 105) is increased, and the output transistor 105 is turned off to reduce the output voltage Vout. In addition, when the output voltage Vout is lower than the predetermined voltage, operations opposite to the above-mentioned operations are performed to increase the output voltage Vout. In this way, the voltage regulator operates so that the output voltage Vout is constant.

Figure 5:
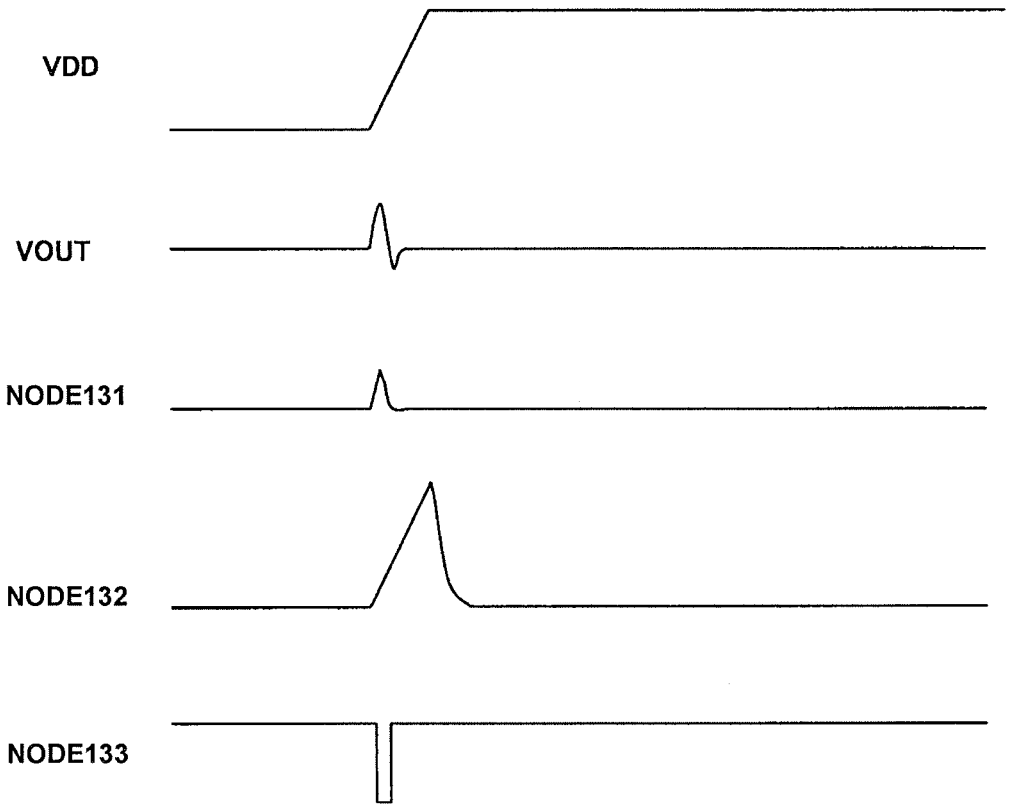
FIG. 5 is a waveform diagram showing an operation of the voltage regulator according to the first embodiment.

Now, the case where the power supply voltage VDD fluctuates is considered. FIG. 5 shows waveforms representing the fluctuations in voltages of the respective nodes when the power supply voltage VDD increases. When the power supply voltage VDD increases, the high pass filter 111 detects the fluctuation in power supply voltage VDD to increase the voltage of the node 132. Along with the increase in power supply voltage VDD, the output voltage Vout also increases, and then the high pass filter 112 detects the fluctuation in output voltage Vout to increase the voltage of the node 131. In this manner, a current I0 flows through the NMOS transistors 113 and 114. The bias circuit 121 causes a current I1 to flow. When the voltages of the nodes 131 and 132 are further increased so that the current I0 becomes larger than the current I1, the bias circuit 121 decreases the voltage of the node 133. Then, the PMOS transistor 115 is turned on to increase the gate voltage of the output transistor 105, thereby controlling the operation of the output transistor 105 to be turned off to suppress overshoot of the output voltage Vout. After the overshoot of the output voltage Vout is suppressed, the power supply voltage VDD continues to increase, but the high pass filter 112 does not detect the fluctuation in output voltage Vout, and hence the voltage of the node 131 does not increase and the NMOS transistor 114 is turned off. Then, the current I0 does not flow, and the PMOS transistor 115 does not operate, and hence the output transistor 105 is not controlled. In this manner, after the control of the overshoot of the output voltage Vout, even when the power supply voltage VDD continues to increase, the output voltage Vout can be maintained to be constant.

Figure 6:
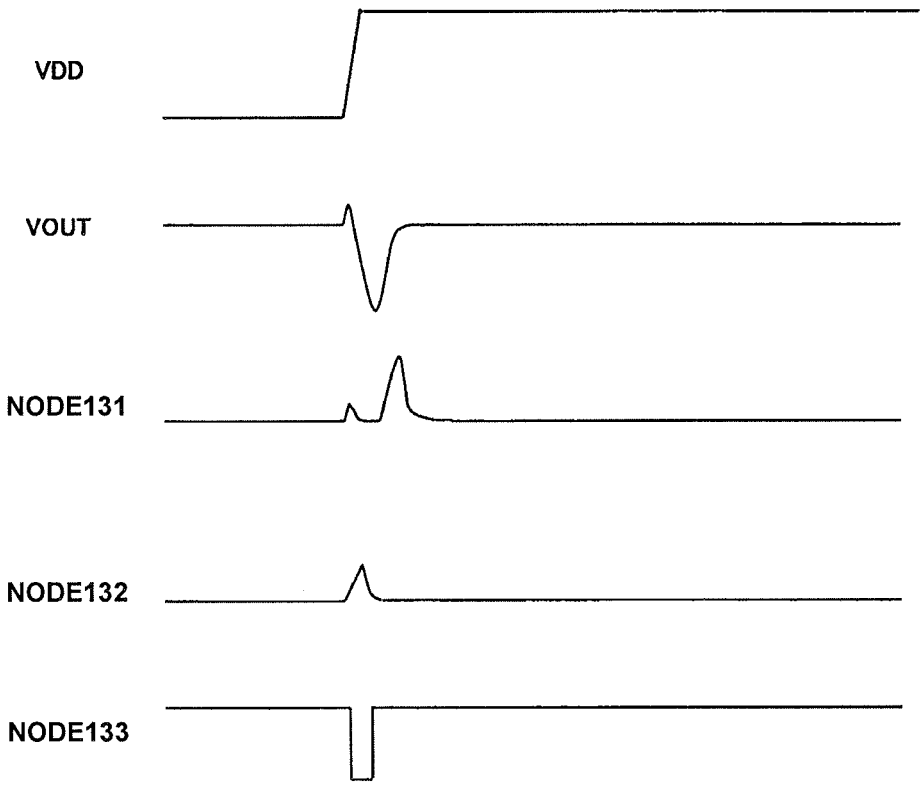
FIG. 6 is a waveform diagram showing another operation of the voltage regulator according to the first embodiment.

FIG. 6 shows waveforms representing the fluctuations in voltages of the respective nodes when the power supply voltage VDD quickly increases under the state in which a heavy load is connected to the output terminal 104. When the power supply voltage VDD increases, the high pass filter 111 detects the fluctuation in power supply voltage VDD to increase the voltage of the node 132. Along with the increase in power supply voltage VDD, the output voltage Vout also increases, and then the high pass filter 112 detects the fluctuation in output voltage Vout to increase the voltage of the node 131. In this manner, the current I0 flows through the NMOS transistors 113 and 114. The bias circuit 121 causes the current I1 to flow. When the voltages of the nodes 131 and 132 are further increased so that the current I0 becomes larger than the current I1, the bias circuit 121 decreases the voltage of the node 133. Then, the PMOS transistor 115 is turned on to increase the gate voltage of the output transistor 105, thereby controlling the operation of the output transistor 105 to be turned off to suppress overshoot of the output voltage Vout. Because the heavy load is connected to the output terminal 104, the output voltage Vout abruptly decreases when the output transistor 105 is turned off. Then, the error amplifier circuit 103 controls the output transistor 105 to abruptly increase the output voltage Vout. In response to the increase in output voltage Vout, the high pass filter 112 increases the voltage of the node 131. However, because the power supply voltage VDD is not increased, the high pass filter 111 does not increase the voltage of the node 132 but turns off the NMOS transistor 113. Thus, the current I0 does not flow, and the PMOS transistor 115 does not control the output transistor 105. In this manner, after the control of the overshoot of the output voltage Vout under the state in which the heavy load is connected, even when undershoot is generated due to the heavy load and the error amplifier circuit 103 controls the output voltage Vout so as to be increased, the PMOS transistor 115 does not control the output transistor, and the output voltage Vout can be maintained to be constant.

Figure 3:
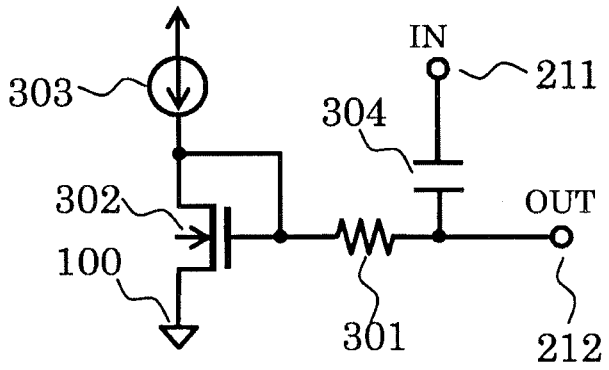
FIG. 3 is a circuit diagram illustrating another exemplary high pass filter.

Note that, the configuration of the high pass filters is described with reference to FIG. 2, but the present invention is not limited to this configuration. A high pass filter having another configuration of FIG. 3 or FIG. 4 may be used. With the configuration of FIG. 3, when a current I2 of a bias circuit 303 is caused to flow through an NMOS transistor 302, a voltage can be biased in advance to an output 212 of the high pass filter. Consequently, even when the fluctuation in power supply voltage VDD or in output voltage Vout is small, a current to be caused to flow through the NMOS transistors 113 and 114 can be easily increased, thus increasing the effect of suppressing the overshoot.

Figure 4:
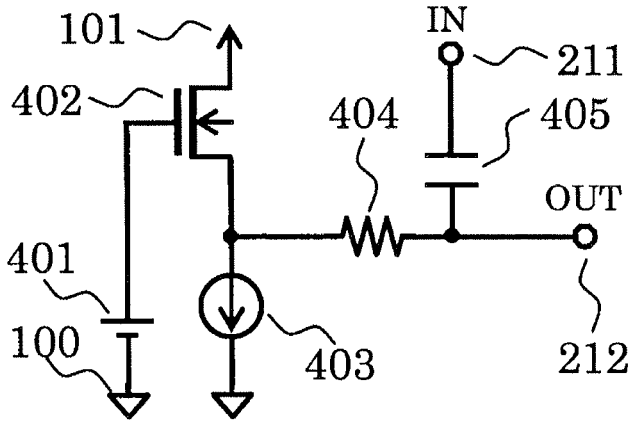
FIG. 4 is a circuit diagram illustrating still another exemplary high pass filter.

When the configuration of FIG. 4 is used, which is a source follower configuration in which a current I3 of a bias circuit 403 is caused to flow through an NMOS transistor 402, a voltage can be biased in advance to the output 212 of the high pass filter based on an output voltage of the source follower. Consequently, even when the fluctuation in power supply voltage VDD or in output voltage Vout is small, a current to be caused to flow through the NMOS transistors 113 and 114 can be easily increased, thus increasing the effect of suppressing the overshoot.

Further, in the above description, the drain of the NMOS transistor 114 is connected to the source of the NMOS transistor 113, but the present invention is not limited to this configuration. The arrangement of the NMOS transistors 113 and 114 may be reversed so that the drain of the NMOS transistor 113 may be connected to the source of the NMOS transistor 114.

As described above, the voltage regulator according to the first embodiment can stabilize the output voltage even when the power supply voltage continues to fluctuate after the overshoot of the output voltage is suppressed. Further, the voltage regulator according to the first embodiment can stabilize the output voltage even when undershoot is generated after the power supply voltage fluctuates under the state in which a heavy load is connected and the overshoot of the output voltage is suppressed.

Second Embodiment

Figure 7:
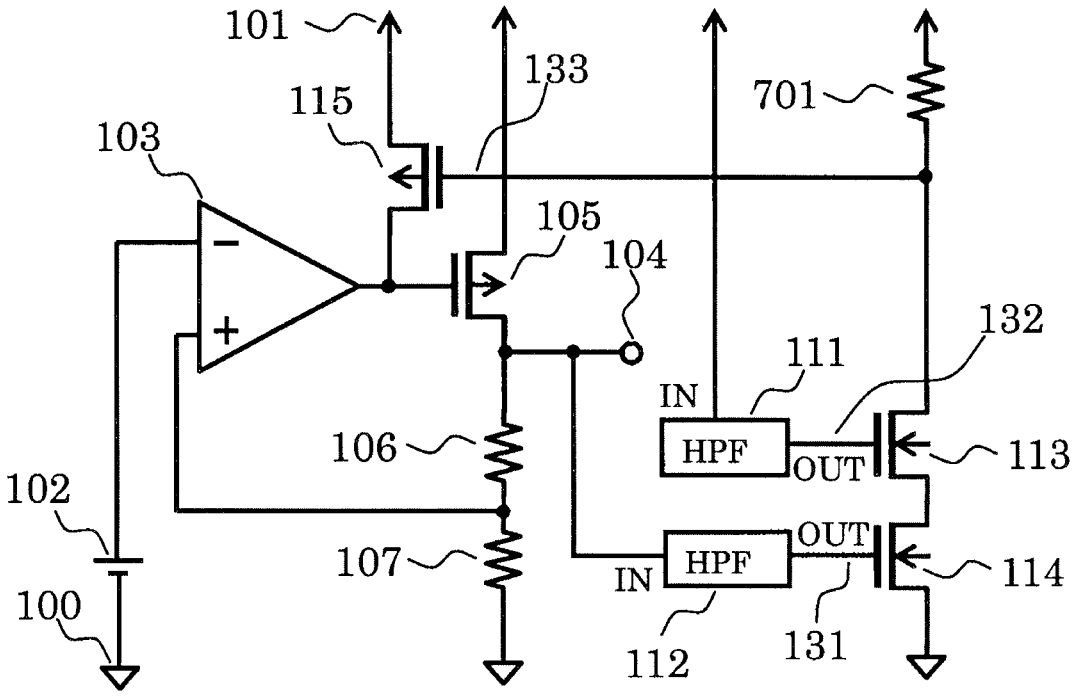
FIG. 7 is a circuit diagram illustrating a configuration of a voltage regulator according to a second embodiment of the present invention.

FIG. 7 is a circuit diagram of a voltage regulator according to a second embodiment of the present invention. FIG. 7 differs from FIG. 1 in that the bias circuit 121 is changed to a resistor 701. The rest is the same as in FIG. 1.

Next, an operation of the voltage regulator according to the second embodiment is described. The operation of maintaining the output voltage Vout to be constant is the same as in the first embodiment. Now, the case where the power supply voltage VDD fluctuates is considered. The operational waveforms are the same as those in the first embodiment. FIG. 5 shows the fluctuations in voltages of the respective nodes when the power supply voltage VDD increases. When the power supply voltage VDD increases, the high pass filter 111 detects the fluctuation in power supply voltage VDD to increase the voltage of the node 132. Along with the increase in power supply voltage VDD, the output voltage Vout also increases, and then the high pass filter 112 detects the fluctuation in output voltage Vout to increase the voltage of the node 131. In this manner, the current I0 flows through the NMOS transistors 113 and 114. When the current I0 flows through the resistor 701, the voltage of the node 133 is decreased. Then, the PMOS transistor 115 is turned on to increase the gate voltage of the output transistor 105, thereby controlling the operation of the output transistor 105 to be turned off to suppress overshoot of the output voltage Vout. After the overshoot of the output voltage Vout is suppressed, the power supply voltage VDD continues to increase, but the high pass filter 112 does not detect the fluctuation in output voltage Vout, and hence the voltage of the node 131 does not increase and the NMOS transistor 114 is turned off. Then, the current I0 does not flow, and the PMOS transistor 115 does not operate, and hence the output transistor 105 is not controlled. In this manner, after the control of the overshoot of the output voltage Vout, even when the power supply voltage VDD continues to increase, the output voltage Vout can be maintained to be constant.

FIG. 6 shows waveforms representing the fluctuations in voltages of the respective nodes when the power supply voltage VDD quickly increases under the state in which a heavy load is connected to the output terminal 104. When the power supply voltage VDD increases, the high pass filter 111 detects the fluctuation in power supply voltage VDD to increase the voltage of the node 132. Along with the increase in power supply voltage VDD, the output voltage Vout also increases, and then the high pass filter 112 detects the fluctuation in output voltage Vout to increase the voltage of the node 131. In this manner, the current I0 flows through the NMOS transistors 113 and 114. When the current I0 flows through the resistor 701, the voltage of the node 133 is decreased. Then, the PMOS transistor 115 is turned on to increase the gate voltage of the output transistor 105, thereby controlling the operation of the output transistor 105 to be turned off to suppress overshoot of the output voltage Vout. Because the heavy load is connected to the output terminal 104, the output voltage Vout abruptly decreases when the output transistor 105 is turned off. Then, the error amplifier circuit 103 controls the output transistor 105 to abruptly increase the output voltage Vout. In response to the increase in output voltage Vout, the high pass filter 112 increases the voltage of the node 131. However, because the power supply voltage VDD is not increased, the high pass filter 111 does not increase the voltage of the node 132 but turns off the NMOS transistor 113. Thus, the current I0 does not flow, and the PMOS transistor 115 does not control the output transistor 105. In this manner, after the control of the overshoot of the output voltage Vout under the state in which the heavy load is connected, even when undershoot is generated due to the heavy load and the error amplifier circuit 103 controls the output voltage Vout so as to be increased, the PMOS transistor 115 does not control the output transistor, and the output voltage Vout can be maintained to be constant.

Note that, the configuration of the high pass filters is described with reference to FIG. 2, but the present invention is not limited to this configuration. A high pass filter having another configuration of FIG. 3 or FIG. 4 may be used.

Further, in the above description, the drain of the NMOS transistor 114 is connected to the source of the NMOS transistor 113, but the present invention is not limited to this configuration. The arrangement of the NMOS transistors 113 and 114 may be reversed so that the drain of the NMOS transistor 113 may be connected to the source of the NMOS transistor 114.

As described above, the voltage regulator according to the second embodiment can stabilize the output voltage even when the power supply voltage continues to fluctuate after the overshoot of the output voltage is suppressed. Further, the voltage regulator according to the second embodiment can stabilize the output voltage even when undershoot is generated after the power supply voltage fluctuates under the state in which a heavy load is connected and the overshoot of the output voltage is suppressed.

Third Embodiment

Figure 8:
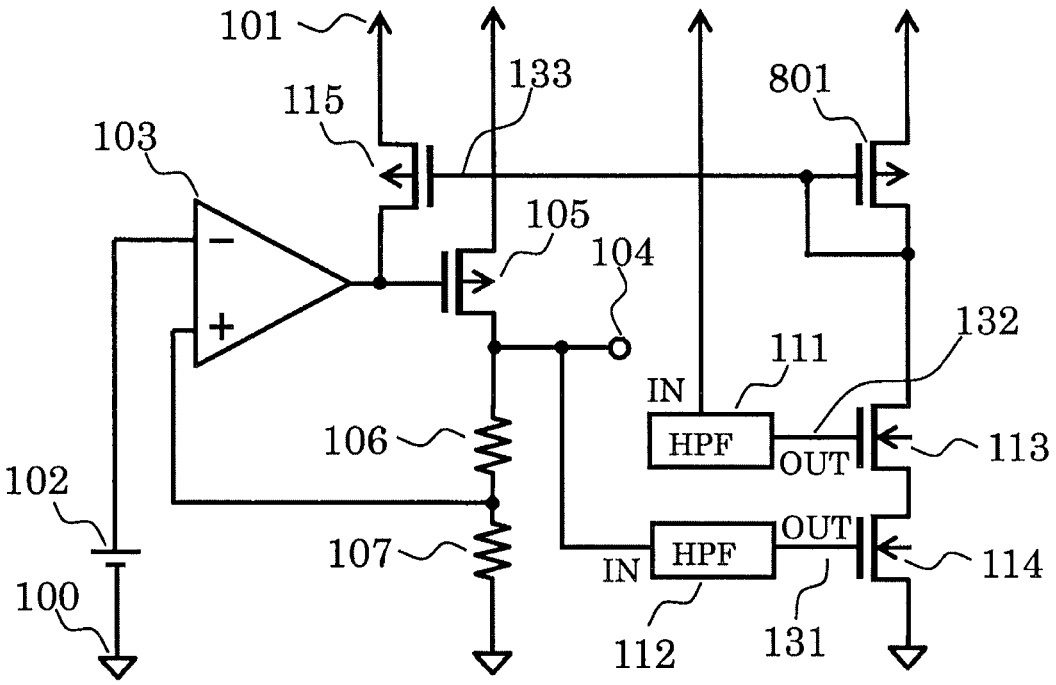
FIG. 8 is a circuit diagram illustrating a configuration of a voltage regulator according to a third embodiment of the present invention.
Figure 9:
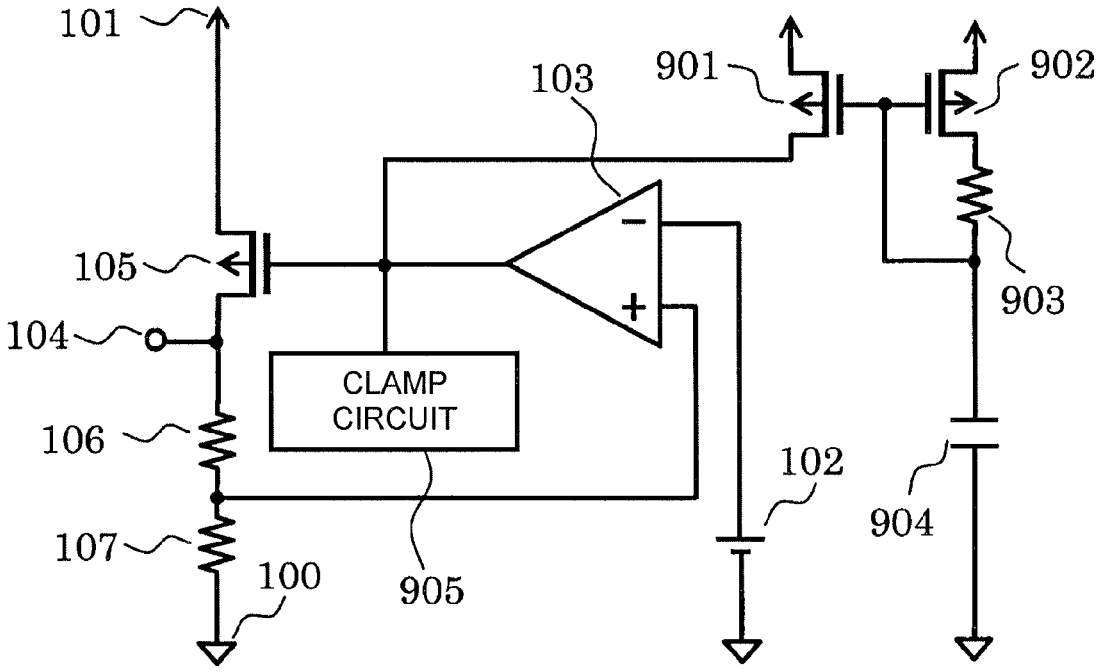
FIG. 9 PRIOR ART
FIG. 9 is a circuit diagram illustrating a configuration of a related-art voltage regulator.

FIG. 8 is a circuit diagram of a voltage regulator according to a third embodiment of the present invention. FIG. 8 differs from FIG. 1 in that the bias circuit 121 is changed to a diode-connected PMOS transistor 801. The rest is the same as in FIG. 1.

Next, an operation of the voltage regulator according to the third embodiment is described. The operation of maintaining the output voltage Vout to be constant is the same as in the first embodiment. Now, the case where the power supply voltage VDD fluctuates is considered. The operational waveforms are the same as those in the first embodiment. FIG. 5 shows the fluctuations in voltages of the respective nodes when the power supply voltage VDD increases. When the power supply voltage VDD increases, the high pass filter 111 detects the fluctuation in power supply voltage VDD to increase the voltage of the node 132. Along with the increase in power supply voltage VDD, the output voltage Vout also increases, and then the high pass filter 112 detects the fluctuation in output voltage Vout to increase the voltage of the node 131. In this manner, the current I0 flows through the NMOS transistors 113 and 114. When the current I0 flows through the diode-connected PMOS transistor 801, the voltage of the node 133 is decreased. Then, the PMOS transistor 115 is turned on to increase the gate voltage of the output transistor 105, thereby controlling the operation of the output transistor 105 to be turned off to suppress overshoot of the output voltage Vout. After the overshoot of the output voltage Vout is suppressed, the power supply voltage VDD continues to increase, but the high pass filter 112 does not detect the fluctuation in output voltage Vout, and hence the voltage of the node 131 does not increase and the NMOS transistor 114 is turned off. Then, the current I0 does not flow, and the PMOS transistor 115 does not operate, and hence the output transistor 105 is not controlled. In this manner, after the control of the overshoot of the output voltage Vout, even when the power supply voltage VDD continues to increase, the output voltage Vout can be maintained to be constant.

FIG. 6 shows waveforms representing the fluctuations in voltages of the respective nodes when the power supply voltage VDD quickly increases under the state in which a heavy load is connected to the output terminal 104. When the power supply voltage VDD increases, the high pass filter 111 detects the fluctuation in power supply voltage VDD to increase the voltage of the node 132. Along with the increase in power supply voltage VDD, the output voltage Vout also increases, and then the high pass filter 112 detects the fluctuation in output voltage Vout to increase the voltage of the node 131. In this manner, the current I0 flows through the NMOS transistors 113 and 114. When the current I0 flows through the diode-connected PMOS transistor 801, the voltage of the node 133 is decreased. Then, the PMOS transistor 115 is turned on to increase the gate voltage of the output transistor 105, thereby controlling the operation of the output transistor 105 to be turned off to suppress overshoot of the output voltage Vout. Because the heavy load is connected to the output terminal 104, the output voltage Vout abruptly decreases when the output transistor 105 is turned off. Then, the error amplifier circuit 103 controls the output transistor 105 to abruptly increase the output voltage Vout. In response to the increase in output voltage Vout, the high pass filter 112 increases the voltage of the node 131. However, because the power supply voltage VDD is not increased, the high pass filter 111 does not increase the voltage of the node 132 but turns off the NMOS transistor 113. Thus, the current I0 does not flow, and the PMOS transistor 115 does not control the output transistor 105. In this manner, after the control of the overshoot of the output voltage Vout under the state in which the heavy load is connected, even when undershoot is generated due to the heavy load and the error amplifier circuit 103 controls the output voltage Vout so as to be increased, the PMOS transistor 115 does not control the output transistor, and the output voltage Vout can be maintained to be constant.

Note that, the configuration of the high pass filters is described with reference to FIG. 2, but the present invention is not limited to this configuration. A high pass filter having another configuration of FIG. 3 or FIG. 4 may be used.

Further, in the above description, the drain of the NMOS transistor 114 is connected to the source of the NMOS transistor 113, but the present invention is not limited to this configuration. The arrangement of the NMOS transistors 113 and 114 may be reversed so that the drain of the NMOS transistor 113 may be connected to the source of the NMOS transistor 114.

As described above, the voltage regulator according to the third embodiment can stabilize the output voltage even when the power supply voltage continues to fluctuate after the overshoot of the output voltage is suppressed. Further, the voltage regulator according to the third embodiment can stabilize the output voltage even when undershoot is generated after the power supply voltage fluctuates under the state in which a heavy load is connected and the overshoot of the output voltage is suppressed.

What is claimed is:

1. A voltage regulator configured to stabilize a power supply voltage input from a power supply terminal to output the stabilized power supply voltage, the voltage regulator comprising:

an output transistor configured to output an output voltage;

an error amplifier circuit configured to amplify a difference between a divide voltage obtained by dividing the output voltage and a reference voltage to output the amplified difference, thereby controlling a gate of the output transistor;

a first high pass filter configured to detect a fluctuation in the power supply voltage;

a second high pass filter configured to detect a fluctuation in the output voltage;

a first transistor configured to cause a current to flow in accordance with an output voltage of one of the first high pass filter and the second high pass filter;

a second transistor connected in series to the first transistor, the second transistor being configured to cause a current to flow in accordance with an output voltage of another one of the second high pass filter and the first high pass filter;

a clamp circuit configured to clamp a drain voltage of the first transistor; and a third transistor including a gate connected to a drain of the first transistor and a drain connected to the gate of the output transistor, the third transistor being configured to control an operation of the output transistor based on the drain voltage of the first transistor.

2. A voltage regulator according to claim 1, wherein the clamp circuit comprises a first bias circuit including one terminal connected to the power supply terminal and another terminal connected to the gate of the third transistor and the drain of the first transistor.

3. A voltage regulator according to claim 1, wherein the clamp circuit comprises a first resistor including one terminal connected to the power supply terminal and another terminal connected to the gate of the third transistor and the drain of the first transistor.

4. A voltage regulator according to claim 1, wherein the clamp circuit comprises a fourth transistor including a gate and a drain that are connected to the gate of the third transistor and the drain of the first transistor.

5. A voltage regulator according to claim 1, wherein the first high pass filter and the second high pass filter each comprise:

a capacitor including one terminal connected to an input terminal of corresponding one of the first high pass filter and the second high pass filter and another terminal connected to an output terminal of the corresponding one of the first high pass filter and the second high pass filter;

a second resistor including one terminal connected to the output terminal of the corresponding one of the first high pass filter and the second high pass filter; and a first constant voltage circuit connected to another terminal of the second resistor.

6. A voltage regulator according to claim 5, wherein the first constant voltage circuit comprises:

a fifth transistor including a gate and a drain connected to each other; and a second bias circuit connected to the gate and the drain of the fifth transistor.

7. A voltage regulator according to claim 5, wherein the first constant voltage circuit comprises:

a source follower circuit; and a second constant voltage circuit connected to an input of the source follower circuit.

* * * * *